US006174390B1

(12) United States Patent
Baba et al.

(10) Patent No.: US 6,174,390 B1
(45) Date of Patent: Jan. 16, 2001

(54) SPIRAL PARTS HEAT TREATMENT APPARATUS AND METHOD, AND SPIRAL PART

(75) Inventors: Tsuyoshi Baba; Tomomasa Nakano, both of Yokohama (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/163,401

(22) Filed: Sep. 30, 1998

(30) Foreign Application Priority Data

Oct. 2, 1997 (JP) ..... 9-270130
Jul. 3, 1998 (JP) ..... 10-188950

(51) Int. Cl.[7] ..... C21D 9/02

(52) U.S. Cl. ..... 148/656; 148/600; 148/580; 148/587; 266/249; 266/78; 266/90

(58) Field of Search ..... 148/600, 656, 148/580, 587; 266/249, 78, 90

(56) References Cited

FOREIGN PATENT DOCUMENTS 5-7961 1/1993 (JP) .

*Primary Examiner*—Deborah Yee
(74) *Attorney, Agent, or Firm*—Fitzpatrick, Cella, Harper & Scinto

(57) ABSTRACT

A spiral parts heat treatment apparatus includes a first guide, a transfer unit, a second guide, and a controller. The first guide has a carrier portion that continuously conveys the manufactured spiral parts carried thereon in a longitudinal direction. The transfer unit is disposed downstream from the first guide to feed the spiral parts one by one after discrimination. The second guide is provided continuously to the transfer unit and has a carrier portion and a driving portion. The carrier portion serves to guide the spiral parts carried thereon in the longitudinal direction in the heat treatment furnace. The driving portion serves to push the spiral parts from a rear end side thereof and a driving portion. The controller performs a control operation so as to feed the spiral parts one by one.

8 Claims, 12 Drawing Sheets

SPIRAL PARTS HEAT TREATMENT APPARATUS AND METHOD, AND SPIRAL PART

BACKGROUND OF THE INVENTION

The present invention relates to a spiral parts heat treatment apparatus and method, and a spiral part, and more particularly, to a technique suitable for a machining and assembling apparatus for a coil spring as a spiral part that requires a heat treatment process.

According to the machining and assembling apparatus for a spring as a spiral part, after a wire such as a music wire or stainless steel wire is coiled, its outer dimension (free length) is inspected, and is heat-treated at about 300° C. to 500° C. for a predetermined period of time in order to remove the residual stress of coiling. For this purpose, a large number of coil springs that have been subjected to coiling are placed together in a case, are placed in the heat treatment furnace of a heat treatment apparatus in units of cases, and are heat-treated.

To automatically assemble coil springs completed in this manner, the coil springs are aligned with an aligning unit, e.g., a parts feeder, and are separated apart from each other one by one. The separated coil spring is held with a robot or the like, is moved, and is built into a container main body or the like.

With this method, since the springs are entangled with each other in the parts feeder, the reliability of alignment before the parts are held with the robot or the like is low, to cause a decrease in operability of the automatic assembly line. As a countermeasure for this, among conventional heat treatment apparatuses, one having an outer appearance shown in the perspective view of FIG. 11 is known.

Referring to FIG. 11, coil springs W manufactured by a spring manufacturing machine 1160 are discriminated by an inspection unit 1150 and are sequentially dropped into a gutter-shaped accepting member 1171. The coil springs W are moved downward along the accepting member 1171 and are spirally passed through a heat treatment furnace 1170, thereby heat-treating the coil springs W.

Alternatively, as in the perspective view of the outer appearance of a conventional heat treatment apparatus shown in FIG. 12, coil springs W manufactured by a spring manufacturing machine 1160 are discriminated by an inspection unit 1150 and are sequentially dropped into a gutter-shaped accepting member 1171. The coil springs W are fitted, with a transfer robot 1181, on pins P that are to hold the springs on a moving belt conveyor. The pins P are passed through a heat treatment furnace 1180 by the belt conveyor, thereby heat-treating the coil springs W.

As disclosed in Japanese Patent Laid-Open No. 5-007961, there is also proposed a "post-treatment apparatus for a coiled product". According to this apparatus, the hook integrally formed with a coil spring is hung from a rod. The hook is positioned with respect to a spiral member which rotates about this rod and which is formed with a spiral groove. The coil springs are fed to a heat treatment unit one by one.

SUMMARY OF THE INVENTION

There is a case where coil springs cannot be heat-treated uniformly if they are batch-processed in a case. In the apparatus having the arrangement described with reference to FIG. 11, since the heat treatment furnace does not have the function of regulating the posture of the coil springs W and contact between the adjacent coil springs, the coil springs may overlap or may be entangled with each other when they collide against each other. When such a situation occurs, the heat treatment time varies to cause nonuniform heat treatment.

If the coil springs W are entangled with each other in the heat treatment furnace, to solve this entangled state, the heat treatment furnace 1170 must be partly opened to decrease the internal furnace temperature, and the internal furnace temperature must be increased again after processing, taking an extra time. This causes a decrease in line operability.

In FIG. 12, since the conveyor is used, the heat treatment furnace 1180 becomes bulky. A transfer device 1181 that picks the coil springs from the coiling machine and places them on the holding pins P on the conveyor one by one is required, leading to an increase in cost. The use of the transfer unit that picks and places the coil springs may cause trouble during transfer, leading to a decrease in line operability. Therefore, the apparatus cannot be directly connected to the automatic assembly line.

With the proposal of Japanese Patent Laid-Open No. 5-007961, although the coil springs can be sequentially conveyed one by one, such conveyance is limited to only a coil spring integrally formed with a hook.

The present invention has been made in consideration of the above problems, and has as its object to provide a spiral parts heat treatment apparatus and method, in which the heat treatment apparatus for a spiral part can be entirely formed simple and an entangled state does not occur, and which can be directly connected to an automatic assembly line, and a spiral part.

It is another object of the present invention to prevent a decrease in operability caused by entanglement of spiral parts and to realize a low-cost apparatus.

In order to solve the problems described above and to achieve the above objects, according to the present invention, there is provided a spiral parts heat treatment apparatus for heat-treating individual ones of continuously conveyed spiral parts by passing the spiral parts through a heat treatment furnace, comprising: first guide means having a carrier portion that continuously conveys manufactured spiral parts carried thereon in a longitudinal direction, transfer means, disposed downstream from the first guide means, for feeding the spiral parts one by one after discrimination, second guide means provided continuously to the transfer means and having a carrier portion and a driving portion, the carrier portion serving to guide the spiral parts carried thereon in the longitudinal direction in the heat treatment furnace, and the driving portion serving to push the spiral parts from a rear end side thereof, and control means, connected to the transfer means and the driving portion, for performing a control operation so as to feed the spiral parts to the second guide means one by one.

The carrier portion of the second guide means is constituted by at least a gutter-shaped member, the heat treatment furnace has an inner wall surface formed into a substantially cylindrical shape, the gutter-shaped member is disposed substantially horizontally along the inner wall surface, and the driving portion is constituted by a plurality of arms extending equidistantly from a rotating shaft which is disposed at a substantially central portion of the heat treatment furnace, and a pusher formed on an end portion of each of the arms to enter the gutter-shaped member, to pass the spiral parts upon rotation of the rotating shaft.

The gutter-shaped member comprises multi-stage gutter-shaped members that are disposed in a vertical direction along the inner wall surface, openings are formed in bottom surfaces of the gutter-shaped members, respectively, to allow free fall of the spiral parts, and positions of upper and lower ones of the openings are offset and the arms are formed as multi-stage arms, so that the spiral parts are allowed to freely fall onto the gutter-shaped members thereunder and are passed to be arranged longitudinally along the inner wall surface.

The carrier portion of the second guide means is constituted by at least a gutter-shaped member, the heat treatment furnace is formed substantially linearly and incorporates the gutter-like member which is substantially linear, the driving portion is constituted by a rotary spiral member and a motor driver, the rotary spiral member having an outer circumferential surface extending along the bottom surface of the gutter-shaped member and which is formed at a pitch substantially corresponding to a longitudinal dimension of the spiral part, and the motor driver serving to rotationally drive the rotary spiral member, and the spiral parts are passed upon rotation of the rotary spiral member.

The carrier portion of the first guide means is formed with an inclined portion inclined to ward the heat treatment furnace, and the transfer means is disposed on the inclined portion to align, retain, and separate the spiral parts.

There is also provided a spiral parts heat treatment method of heat-treating individual ones of continuously conveyed spiral parts by passing the spiral parts through a heat treatment furnace, comprising the steps of: conveying, with first guide means having a carrier portion that continuously conveys the spiral parts, manufactured spiral parts carried on the carrier portion in a longitudinal direction, conveying the spiral parts with transfer means, disposed downstream from the first guide means, for feeding the spiral parts one by one after discrimination, causing the spiral parts to pass through the heat treatment furnace by second guide means, provided continuously to the transfer means and having a carrier portion and a driving portion, the carrier portion serving to guide the spiral parts carried thereon in the longitudinal direction in the heat treatment furnace, and the driving portion serving to push the spiral parts from a rear end side thereof, and feeding the spiral parts to the second guide means one by one with control means connected to the transfer means and the driving portion.

In the spiral parts heat treatment method, the carrier portion of the second guide means is constituted by at least a gutter-shaped member, the heat treatment furnace has an inner wall surface formed into a substantially cylindrical shape, the gutter-shaped member is disposed substantially horizontally along the inner wall surface, and the driving portion is constituted by a plurality of arms extending equidistantly from a rotating shaft which is disposed at a substantially central portion of the heat treatment furnace, and a pusher formed on an end portion of each of the arms to enter the gutter-shaped member, to pass the spiral parts upon rotation of the rotating shaft.

In the spiral parts heat treatment method, the gutter-shaped member comprises multi-stage gutter-shaped members that are disposed in a vertical direction along the inner wall surface, openings are formed in bottom surfaces of the gutter-shaped members, respectively, to allow free fall of the spiral parts, and positions of upper and lower ones of the openings are offset and the arms are formed as multi-stage arms, so that the spiral parts are allowed to freely fall onto the gutter-shaped members thereunder and are passed to be arranged longitudinally along the inner wall surface.

In the spiral parts heat treatment method, the carrier portion of the second guide means is constituted by at least a gutter-shaped member, the heat treatment furnace is formed substantially linearly and incorporates the gutter-like member which is substantially linear, the driving portion is constituted by a rotary spiral member which has an outer circumferential surface extending along the bottom surface of the gutter-shaped member and which is formed at a pitch substantially corresponding to a longitudinal dimension of the spiral part, and a motor driver for rotationally driving the rotary spiral member, and the spiral parts are passed upon rotation of the rotary spiral member.

In the spiral parts heat treatment method, the carrier portion of the first guide means is formed with an inclined portion inclined to ward the heat treatment furnace, and the transfer means is disposed on the inclined portion to align, retain, and separate the spiral parts.

There is also provided a spiral part which is heat-treated in accordance with the spiral parts heat treatment method, wherein heat treatment is performed, after manufacture of a coil spring, to remove internal strain.

A belt member is pivotally disposed. The belt member is wound on driving members that are separated from each other at a predetermined distance, and has an outer circumferential surface which is connected to a plurality of partitions that are vertically upright, at a distance corresponding to a size of the spiral parts, from the outer circumferential surface. The spiral parts are conveyed from upstream to downstream within a space defined by a convey path and the partitions that partition in front of and behind the spiral parts.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

Preferred embodiments of the present invention will be described with reference to the accompanying drawings.

Figure 1:
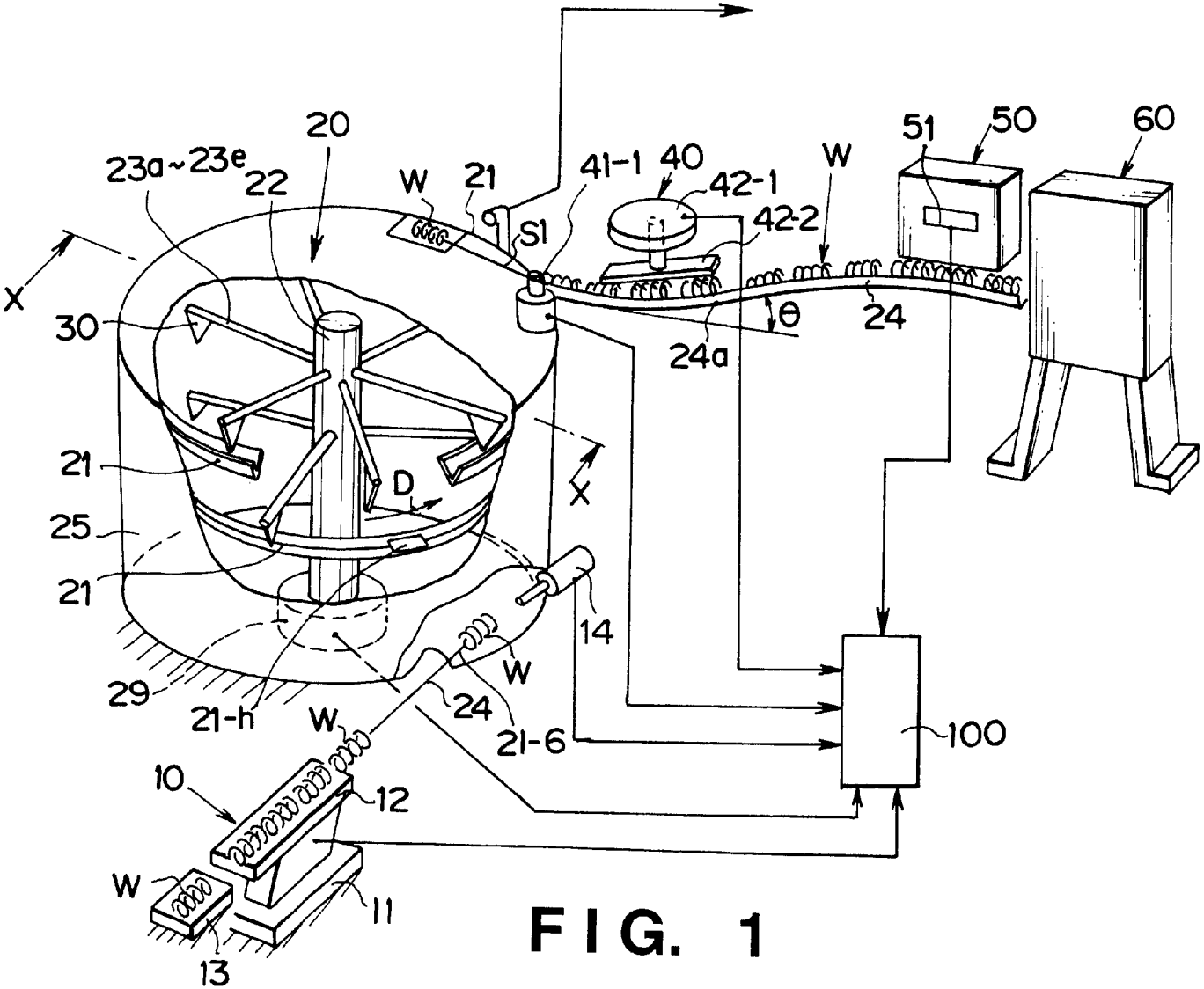
FIG. 1 is a perspective view showing the outer appearance of the entire arrangement of a heat treatment apparatus according to the first embodiment of the present invention.

FIG. 1 is a perspective view showing the outer appearance of the entire arrangement of a spiral parts heat treatment apparatus, in which the main part of the apparatus is shown as a partially cutaway view. Referring to FIG. 1, a coiling unit 60 forms a coil spring W as a spiral part by coiling. Although the coil spring W as a spiral part which requires heat treatment will be described in the following explanation, the present invention is not limited to this, but can be applied to any component, e.g., a lead screw, a bolt, or the like, in which a spiral groove is formed in its outer surface in the longitudinal direction.

A measurement unit 50 for measuring the free length of the coil spring W with a non-contact sensor 51 is disposed downstream from the coiling machine 60. When coiling is ended, the measurement unit 50 measures the free length of the coil spring W while holding the coil spring W. A nondefective product is fed onto a gutter rail 24 in order to flow to a subsequent process, while a defective product is discharged with a discharge machine (not shown), thereby discriminating the coil springs W.

The gutter rail 24 is formed with an inclined portion 24*a* which extends downward with an angle θ. The inclined portion 24*a* allows the coil spring W to move downward so as to flow with its own weight, thereby eliminating extra moving power.

A separation unit 40 for introduction to separate one coil spring W to be introduced into a heat treatment furnace 20 is disposed on the inclined portion 24*a*. The separation unit 40 is constituted by a cylinder 41-2, a gate pin 41-1, a pusher cylinder 42-1, and a pusher 42-2. The cylinder 41-2 actuates a gate for stopping the flow of the coil springs, so that the coil springs W are introduced into the heat treatment furnace 20 one by one. The pusher cylinder 42-1 presses the coil springs W. The pusher 42-2 is fixed to the pusher cylinder 42-1.

A sensor Sl detects the presence/absence of the coil spring W at the inlet port of the heat treatment furnace.

Figure 2:
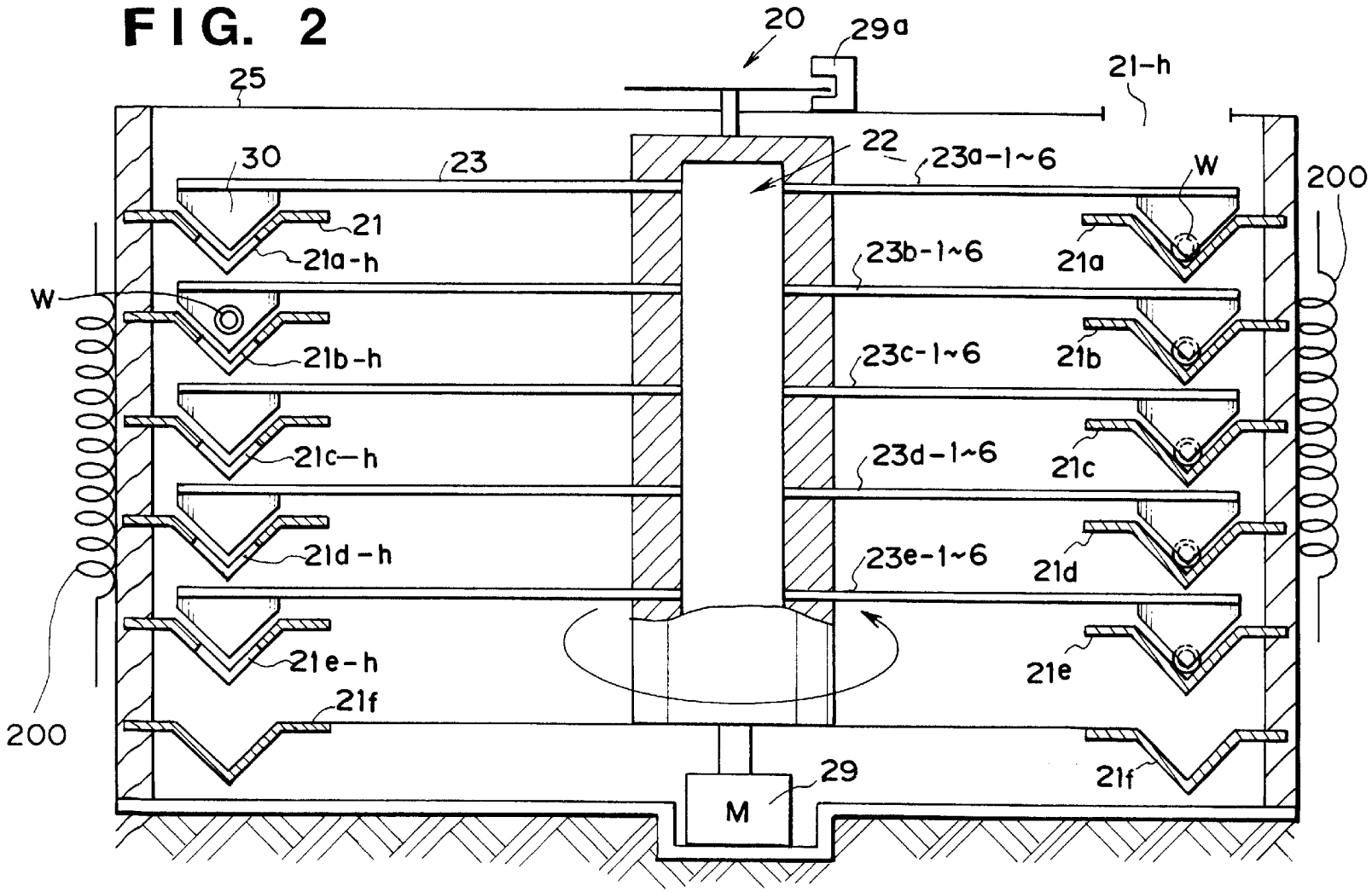
FIG. 2 is a sectional view taken along the line of arrows X—X of FIG. 1.
Figure 3A:
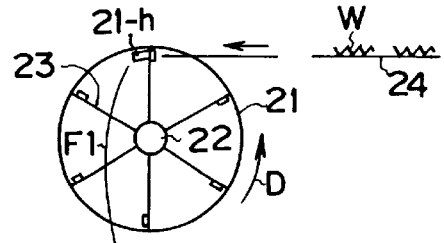
FIGS. 3A to 3G are diagrams for explaining the operation of the heat treatment apparatus.
Figure 3B:
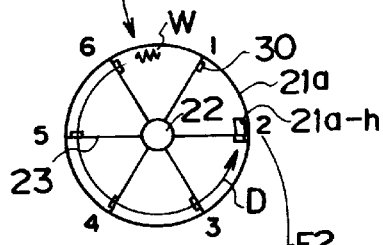
Figure 3C:
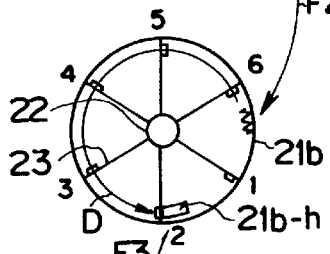
Figure 3D:
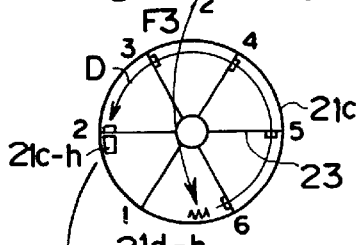
Figure 3E:
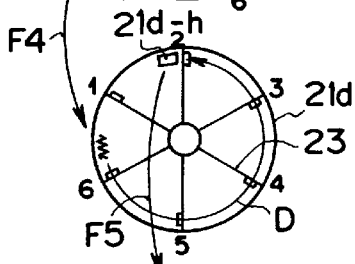
Figure 3F:
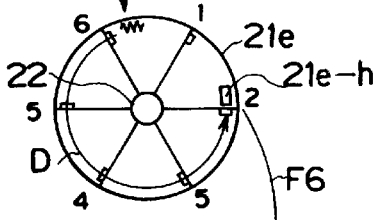
Figure 3G:
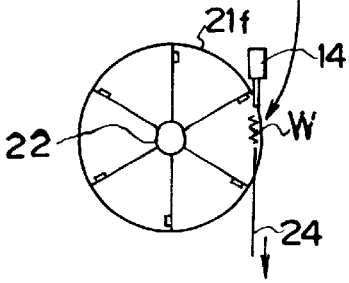

FIG. 2 is a sectional view taken along the line of arrows X—X of FIG. 1. Referring to FIG. 1 as well as FIG. 2, a 0th-stage gutter rail 21 is formed in the uppermost stage of the heat treatment furnace 20. The gutter rail 21 is formed with a hole 21-h for dropping the coil spring W.

The heat treatment furnace 20 is constituted by a cylindrical furnace main body 25 made of a heat-insulating material so that heat from a heater 200 on its side surface will not leak to the outside. Vane assemblies 23*a* to 23*e* are vertically fixed in the furnace main body 25. Press portions 30 for pushing and moving the trailing end portions of the coil springs W are fixed to the vanes of each vane assembly, and six spoke-like vanes are arranged on each vane assembly at an angular interval of 60°. The vane assemblies 23*a* to 23*e* are fixed to a shaft 22 to be shifted from each other by 30°. The output shaft of a motor 29 is fixed to the shaft 22. Upon rotation of the shaft 22, vanes 23*a*-1 to 23*a*-6, 23*b*-1 to 23*b*-6, 23*c*-1 to 23*c*-6, 23*d*-1 to 23*d*-6, and 23*e*-1 to 23*e*-6 are rotated simultaneously to push the trailing ends of the coil springs W. Hence, the coil springs W are moved on the rails to sequentially drop onto a rail below them through the dropping holes 21*a*-h to 21*e*-h of the gutter rails 21*a* to 21*e*.

Figure 4:
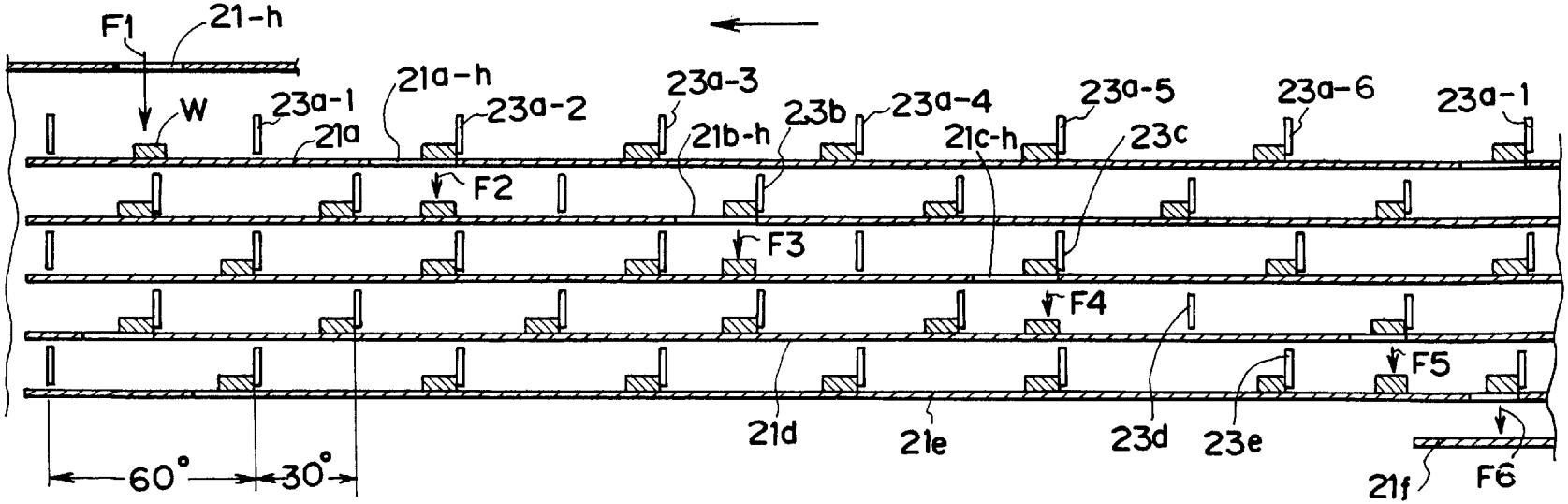
FIG. 4 is a developed view for explaining the operation of the heat treatment apparatus.

Referring to FIGS. 3A to 3G showing the operation principle and the developed view of FIG. 4 for explaining the operation, the holes 21*a*–h to 21*e*–h for dropping the coil springs W are formed in the gutter rails 21*a* to 21*e*, respectively, and six vanes 23 are formed to extend radially from the shaft 22. Furthermore, five internal furnace mechanisms for feeding the coil springs W in the circumferential direction are arranged in the vertical direction. Each mechanism has one gutter rail 21, one hole 21-h for dropping the coil springs W, and six vanes 23 which are arranged on the circumference of each vane assembly.

The vane 23 of the highest mechanism for feeding the coil springs W in the circumferential direction, and the vane 23 of the second highest mechanism for feeding the coil springs W in the circumferential direction are phase-shifted from each other by 30°. The vane 23 of the second highest mechanism for feeding the coil springs W in the circumferential direction, and the vane 23 of the third highest mechanism for feeding the coil springs W in the circumferential direction are phase-shifted from each other by 30°. The vane 23 of the third highest mechanism for feeding the coil springs W in the circumferential direction, and the vane 23 of the fourth highest mechanism for feeding the coil springs W in the circumferential direction are phase-shifted from each other by 30°. The vane 23 of the fourth highest mechanism for feeding the coil springs W in the circumferential direction, and the vane 23 of the fifth highest mechanism for feeding the coil springs W in the circumferential direction are phase-shifted from each other by 30°.

The vanes 23*a*-1 to 23*a*-6, 23*b*-1 to 23*b*-6, 23*c*-1 to 23*c*-6, 23*d*-1 to 23*d*-6, and 23*e*-1 to 23*e*-6 are connected to the shaft 22 to be shifted from each other by 30°. The shaft 22 is rotatably supported by the furnace main body 25. A controller for controlling the internal furnace temperature, and the heater 200 for increasing the internal furnace temperature are also provided.

Referring to FIG. 1 again, a unit 10 aligns and retains the coil springs W which have been subjected to coiling and heat treatment, and separates them apart from each other one by one. A guide 12 aligns the coil springs W in a row with a rail. A vibrator 11 moves the coil springs W by transmitting vibration to them in the direction of feeding the coil springs W (from the right to the left in FIG. 1). A separation piece 13 separates one coil spring W on the to p from the remaining ones to convey each separated coil spring W to the subsequent step with a transfer robot (not shown).

Figure 5:
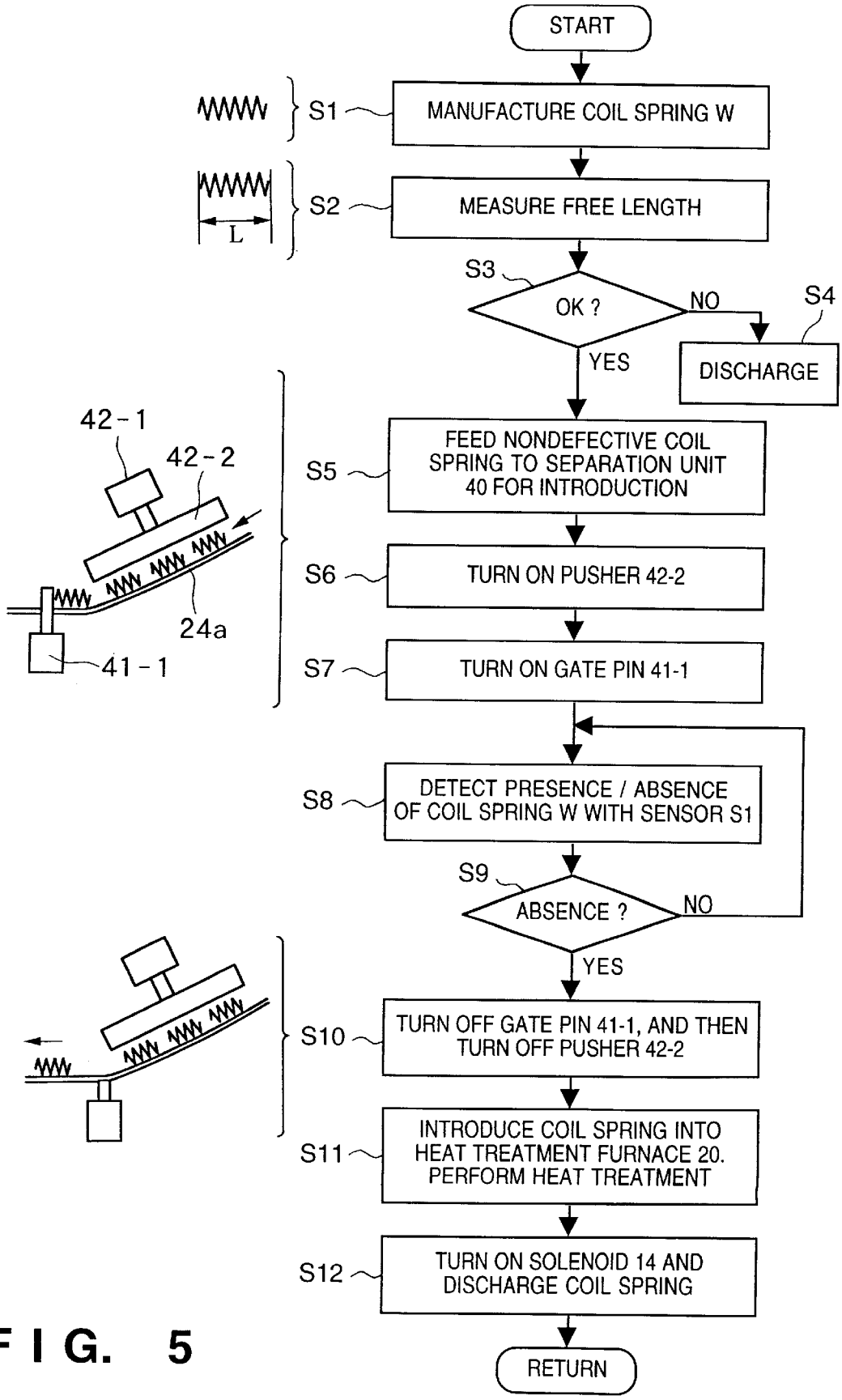
FIG. 5 is a flow chart for explaining the operation of the heat treatment apparatus.

In the apparatus having the above arrangement, its operation will be explained with reference to the flow chart of FIG. 5. In step S1, a coil spring W is coiled with the coiling machine 60 that forms the coil spring W by coiling. In step S2, the free length of the coil spring W is measured with the non-contact sensor 51 at the end of coiling. It is determined whether the coil spring W is a nondefective product (step S3). A defective product is discharged with a discharge machine (step S4).

If the coil spring W is determined as a nondefective product, the coiled and inspected coil spring W is dropped onto the gutter rail 24 in step S5. The gutter rail 24 is formed with the inclined portion 24*a*, and the coil spring W slides down along the inclined portion 24*a*. In step S6, the cylinder 41-2 for actuating the flow stopping gate of the separation unit 40 that introduces the coil springs W into the heat treatment furnace one by one is turned on. In step S7, the gate pin 41-1 is turned on to dam the flow of the coil springs W. More specifically, the coil springs W next to the dammed coil spring W are pressed by the pusher 42-2 of the pusher cylinder 42-1 that presses the coil springs W.

In step S8, the presence/absence sensor S1 for the coil spring W at the inlet port of the heat treatment furnace confirms absence of the coil spring W. Then, the gate pin 41-1 is opened and the coil spring W slides down along the gutter rail 21 to fall onto the first-stage gutter rail 21*a* in the heat treatment furnace through the dropping hole 21-h for the coil spring W.

Hence, the presence/absence sensor S1 at the inlet port of the heat treatment furnace confirms the presence of the coil spring W. Hence, the gate pin 41-1 is closed and the pusher 42-2 is opened. Thereafter, the pusher 42-2 is actuated to press the coil springs W with its press portion (steps S9 and S10).

Referring to FIG. 4, the vane 23*a*-1 for feeding the coil spring W is located at a position backward by about 15° from the position of the (first) coil spring W that has dropped previously. The vane 23*a*-2 for feeding the coil spring W is located at a position backward by 30° from the vane 23*a*-1. The vane 23*a*-3 for feeding the coil spring W is located at a position backwardby 30° from the vane 23*a*-2. The vane 23*a*-4 for feeding the coil spring W is located at a position backward by 30° from the vane 23*a*-3. The vane 23*a*-5 for feeding the coil spring W is located at a position backward by 30° from the vane 23*a*-4. The vane 23*a*-6 for feeding the coil spring W is located at a position backward by 30° from the vane 23*a*-5. In fine, a to tal of 6 vanes 23 are present.

When the entire assembly is rotated through 30°, the coil spring W that has dropped through the dropping hole for the coil spring W moves in the gutter rail 21*a* for a distance corresponding to 15°, and the presence/absence sensor S1 for the coil spring W at the inlet port of the heat treatment furnace determines the absence of the coil spring W.

Then, the operation gate pin that introduces the coil springs W into the heat treatment furnace one by one is opened and closed, and at the same time the coil springs W are dammed and held, so that the second coil spring W slides down along the gutter rail 21 to fall onto the first-stage gutter rail 21*a* in the heat treatment furnace through the dropping hole 21-h for the coil springs W. (In step S11, the second coil spring W is supplied to the inlet port of the furnace).

The presence/absence sensor S1 for the coil spring W at the inlet port of the heat treatment furnace confirms the presence of the coil spring W. The vane 23*a*-2 for the coil spring W is located at a position backward by about 15° from the position where the (second) coil spring W has dropped. (In this manner, the respective vanes 23 are located to be shifted from each other by 30°.)

When the first-stage circumferential feed mechanism (same applies to the second- to fifth-stage circumferential feed mechanisms) is rotated through 30°, the vane 23*a*-2 pushes the trailing end of the coil spring W with its press portion 30 to rotationally move the coil spring W for about 15°. When the operation of rotationally supplying the coil spring W is repeated for another three times, the first coil spring W drops onto the gutter rail 21*b* of the second-stage circumferential feed mechanism through the dropping hole 21*a*-h.

When the first-stage circumferential feed mechanism is rotated through another 30°, the coil spring W has rotated through a total of 360° (one turn). The second-stage circumferential feed mechanism repeats the same operation as this for five times, and the coil spring W drops onto the gutter rail 21*c* of the third-stage circumferential feed mechanism through the dropping hole 21*b* -h.

When the second-stage circumferential feed mechanism is rotated through another 30°, the coil spring W has rotated through a total of 360° (one turn).

The third-stage circumferential feed mechanism repeats the same operation as this for five times, and the coil spring W drops onto the gutter rail 21*d* of the fourth-stage circumferential feed mechanism through the dropping hole 21*c* –h.

When the third-stage circumferential feed mechanism is rotated through another 30°, the coil spring W has rotated through a to tal of 360° (one turn).

The fourth-stage circumferential feed mechanism repeats the same operation as this for five times, and the coil spring W drops onto the gutter rail 21*e* of the fifth-stage circumferential feed mechanism through the dropping hole 21*d–h*. When the fourth-stage circumferential feed mechanism is rotated through another 30°, the coil spring W has rotated through a to tal of 360° (one turn).

The fifth-stage circumferential feed mechanism repeats the same operation as this for four times, and the coil spring W drops onto the sixth-stage gutter rail 21*f* outside the heat treatment furnace through the dropping hole 21*e*–h. Heat treatment is completed through this process.

The coil spring W which has dropped onto the sixth-stage gutter rail 21*f* is moved to the gutter rail 24 by a pusher 14. By repeating this operation, the coil springs W are moved onto the unit 10. The unit 10 aligns and retains the coil springs W which have undergone coiling and heat treatment, and separates them apart from each other one by one.

The vibrator 11 moves the coil springs W to the left on the sheet of the drawing of FIG. 1 by vibration.

One coil spring W which has been separately placed on the separation piece 13 is built into a container main body (not shown) with the coil spring transfer unit of a robot or the like (not shown).

Figure 6:
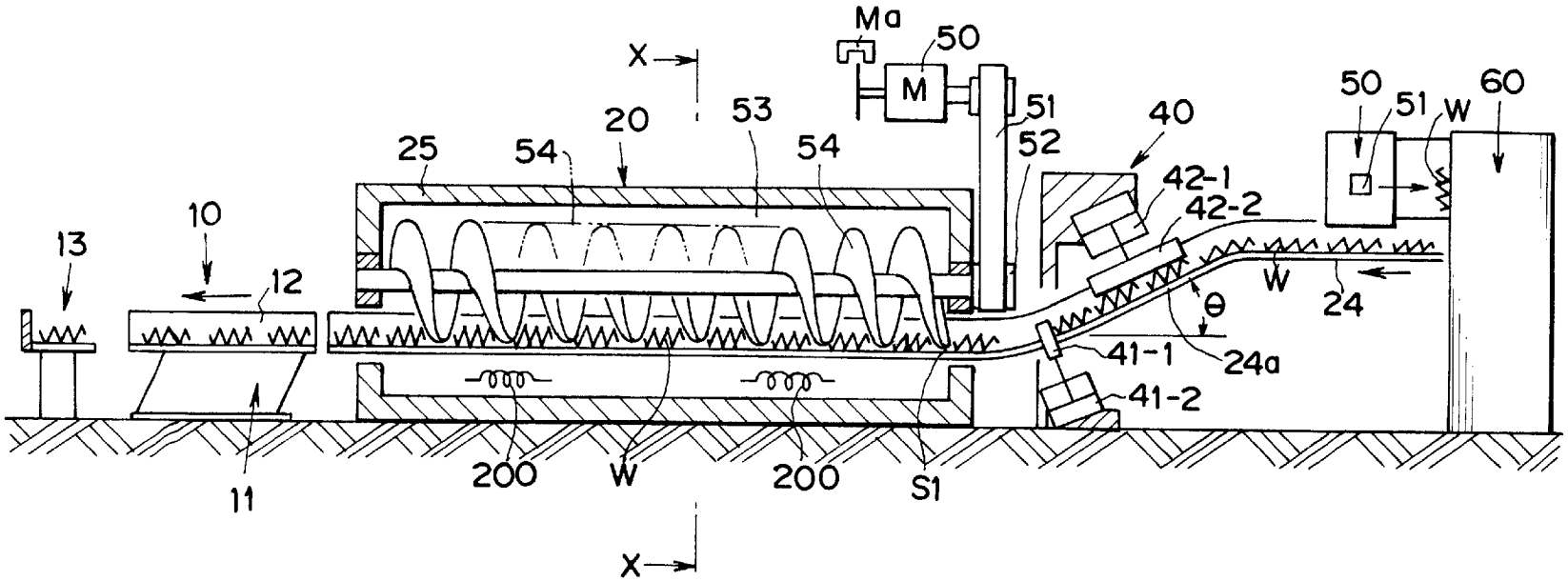
FIG. 6 is a view showing the entire arrangement of a heat treatment apparatus according to the second embodiment of the present invention.

FIG. 6 schematically shows the arrangement of a heat treatment furnace 20 having another arrangement. Referring to FIG. 6, portions that are identical to those that have been described are denoted by the same reference numerals to omit a repetitive description. A furnace main body 25 is made of a heat-insulating material.

A screw-like spiral feed member 54 moves coil springs W. The spiral feed member 54 is connected to a shaft 53 and is supported to be rotatable in the longitudinal direction of the furnace main body 25.

A pulley 52 is connected to the shaft 53 and is interlocked with another pulley through a belt 51. This another pulley is connected to a motor 50.

In the above arrangement, a coil spring W is coiled by a coiling machine 60 that forms the coil springs W by coiling. When coiling is ended, a noncontact sensor 51 measures the free length of the coil spring W while holding the coil spring W. A nondefective product is fed to the subsequent step while a defective product is discharged with a discharge machine (not shown). The coil spring W after coiling is dropped onto a gutter rail 24.

The gutter rail 24 is formed with an inclined portion 24*a* to allow the coil spring W to slide down along it.

A separation unit 40 for introduction introduces the coil springs W into a heat treatment furnace one by one. In order to introduce the coil springs W, the coil springs W are dammed with a cylinder 41-2 and a gate pin 41-1. The cylinder 41-2 actuates a gate for damming the flow of the coil springs W. The coil springs W next to the dammed coil spring W are pressed by a pusher 42-2 of a pusher cylinder 42-1 that presses the coil springs W.

When a presence/absence sensor S1 at the inlet port of the heat treatment furnace 20 confirms the absence of the coil spring W, the gate pin 41-1 is opened and the coil spring W slides down. When the coil spring W reaches the inlet port of the furnace, the presence/absence sensor S1 at the inlet port of the heat treatment furnace 20 senses the presence of the coil spring W. In this case, the screw-like spiral feed member 54 for moving the coil springs W is rotated to move the coil springs W.

To close a gate 41, the pusher 42-2 is opened. The coil spring W slides down and is dammed by the gate 41.

Figure 7:
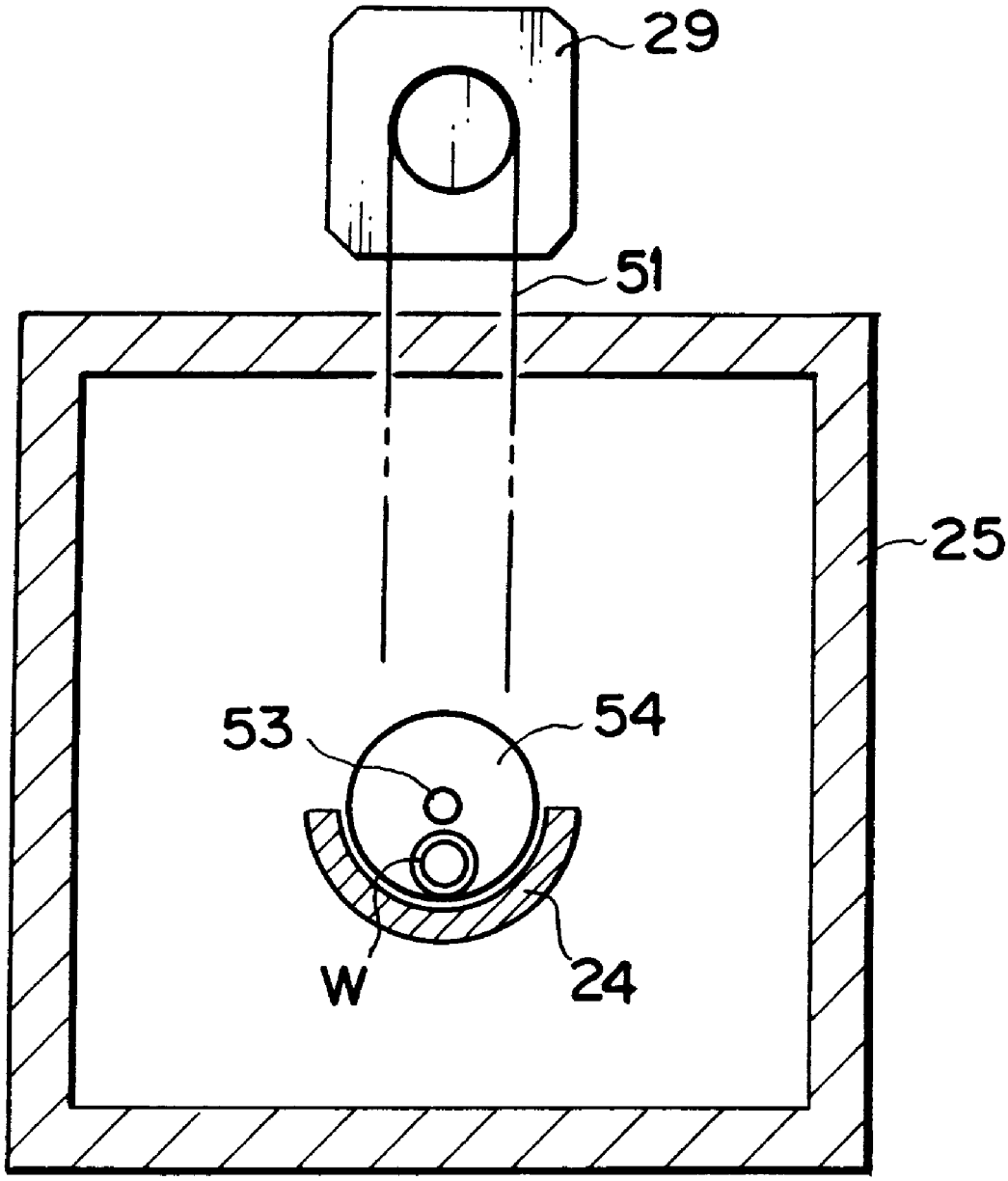
FIG. 7 is a sectional view taken along the line of arrows X—X of FIG. 6.

The screw-like spiral feed member 54 is rotated to move the coil springs W as shown in FIG. 7, which is a sectional view taken along the line of arrows X—X of FIG. 6.

When the presence/absence sensor S1 at the inlet port of the heat treatment furnace 20 confirms the absence of the coil spring W, the separation unit 40 introduces one coil spring W. By repeating this operation, the coil springs W are heat-treated at the preset temperature for a time of the heat treatment conditions.

When the above operation is further repeated, the coil springs W are moved onto a unit 10. The unit 10 aligns and retains the coil springs W which have undergone coiling and heat treatment, and separates them apart from each other one by one. A vibrator 11 moves the coil springs W to the left on the sheet of the drawing of FIG. 1 by vibration. One coil spring W which has been separately placed on a separation piece 13 is built into a container main body (not shown) with the coil spring transfer unit of a robot or the like (not shown).

As described above, the separation unit 40 for introduction is provided before the heat treatment furnace 20 to reliably introduce the coil springs W one by one. Since the coil springs W are conveyed on the gutter rail in the heat treatment furnace 20 with vanes so as not to cause interference and collision among them, they are not entangled with each other. Therefore, a decrease in operability is not caused in an automatic assembly line, and this apparatus can be directly connected to the automatic assembly line.

As described above, according to the present invention, there is provided a spiral parts heat treatment apparatus and method, in which the heat treatment apparatus for a spiral part can be simple as a whole and an entangled state does not occur, and which can be directly connected to an automatic assembly line, and a spiral part.

The third embodiment of the present invention will be described in detail with reference to the accompanying drawings.

Figure 8:
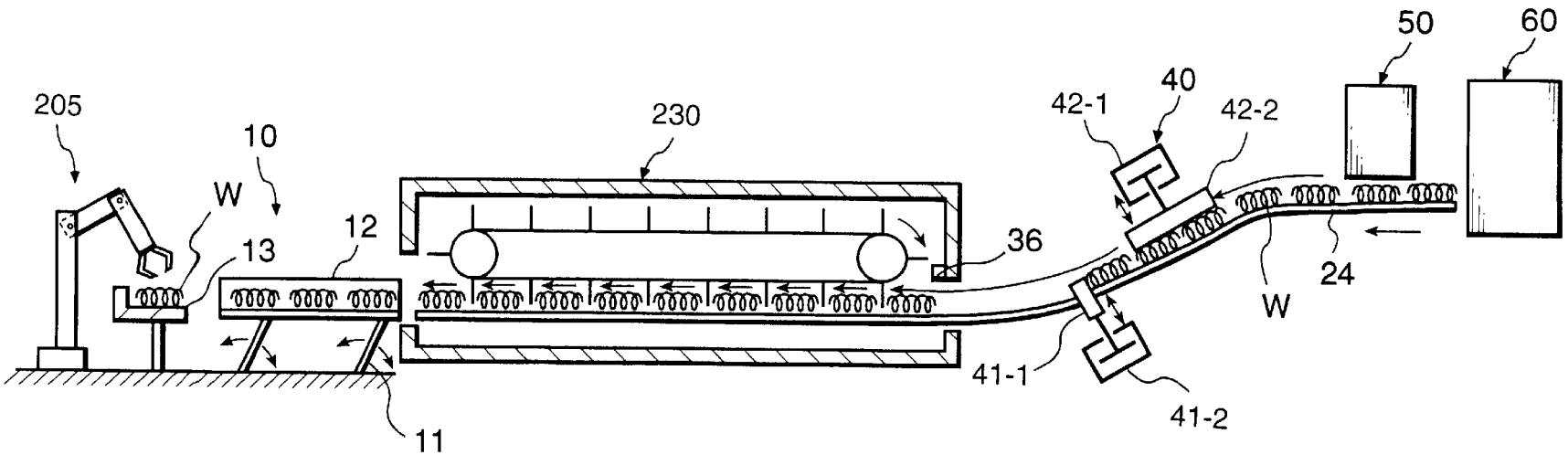
FIG. 8 is a view showing the entire arrangement of a heat treatment apparatus according to the third embodiment of the present invention.
Figure 9:
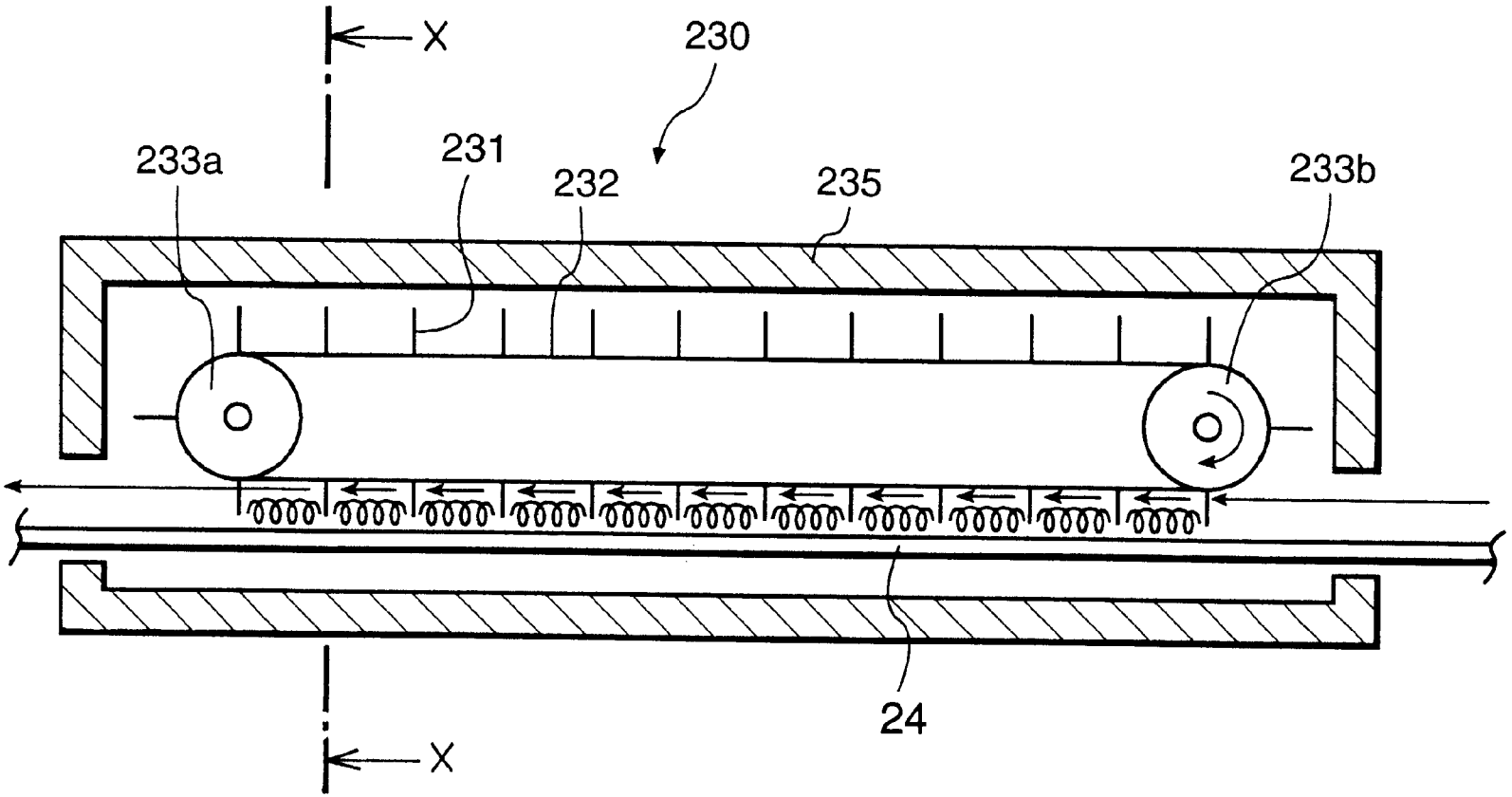
FIG. 9 is a sectional view of the main part of FIG. 8.
Figure 10:
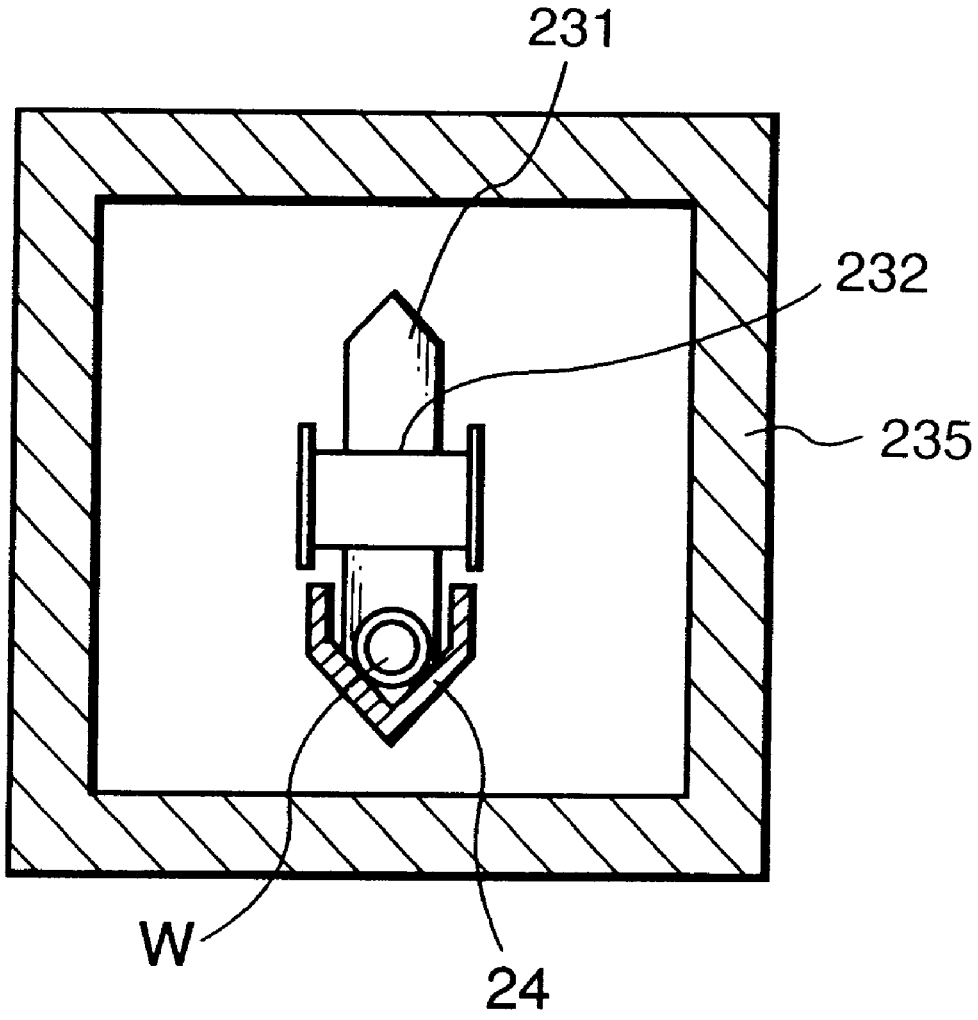
FIG. 10 is a sectional view taken along the line of arrows X—X of FIG. 9.
Figure 11:
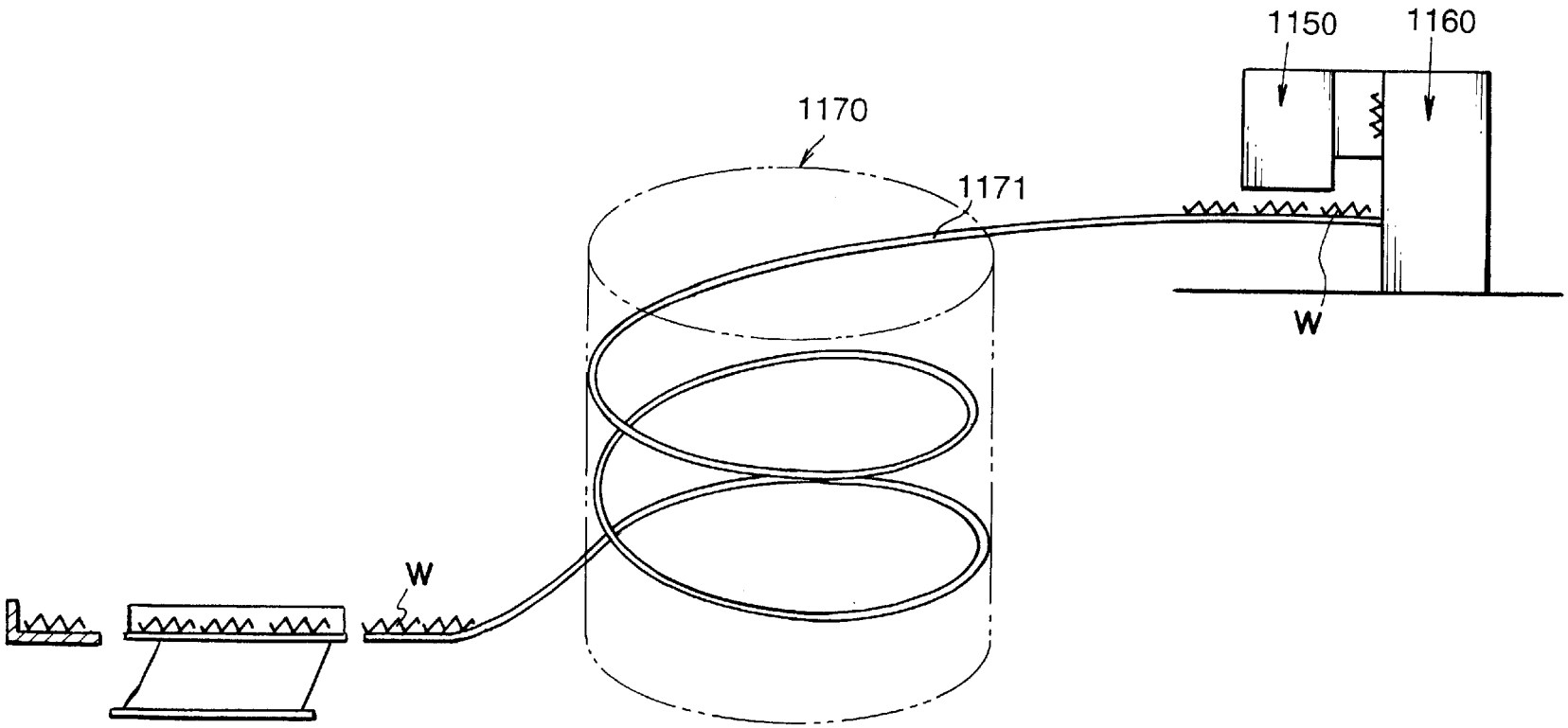
FIG. 11 (PRIOR ART)
FIG. 11 is a view showing the overall arrangement of a conventional spring machining and assembling apparatus.
Figure 12:
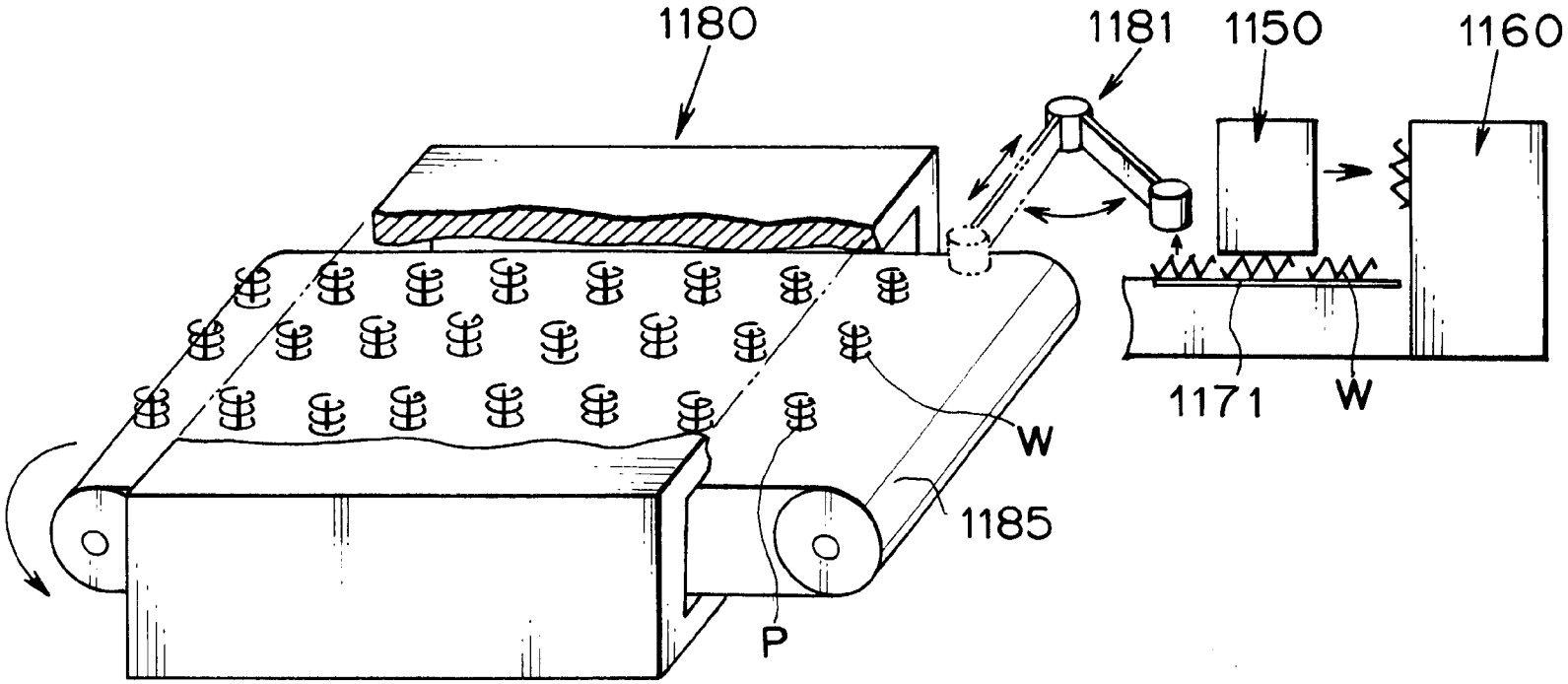
FIG. 12 (PRIOR ART)
FIG. 12 is a view showing the overall arrangement of another conventional spring machining and assembling apparatus.

FIG. 8 shows the entire process from a spring manufacturing step to a build-in step. FIG. 9 shows the heat treatment apparatus shown in FIG. 8. FIG. 10 is a sectional view of the rail taken along the line of arrows X—X of FIG. 9.

Referring to FIG. 8, in the manufacturing line including the work convey unit of this embodiment, a coil spring W as a work coiled by spring coiling unit 60 arranged most upstream is conveyed along a rail 24 to a parts build-in unit 205 arranged most downstream. As shown in FIG. 10, the rail 24 is formed into a gutter-like shape with inclined surfaces to have a V-shaped section.

The spring coiling unit 60 arranged most upstream coils a wire such as a music wire or a stainless steel wire. A measurement unit 50 is arranged downstream the spring coiling unit 60 to be close to it. The measurement unit 50 inspects the outer dimension of the free length of the coil spring W, coiled by the spring coiling unit 60, with a noncontact optical sensor or the like. A nondefective product is conveyed to a subsequent heat treatment step, while a defective product is discharged with a discharge unit (not shown) to the outside of the line.

A separation unit 40 is arranged downstream the measurement unit 50 to separate the coil springs W introduced into the heat treatment furnace of a heat treatment apparatus 230 one by one. The separation unit 40 has a flow stopping gate pin 41-1, a gate cylinder 41-2, a pusher 42-2, and a pusher cylinder 42-1. The gate pin 41-1 serves to introduce the coil springs W, conveyed on the rail 24, into the heat treatment furnace one by one. The gate cylinder 41-2 actuates the gate pin 41-1. The pusher 42-2 pushes the coil springs W on the rail 24 against the rail 24. The gate pin 41-1 is arranged downstream the pusher 42-2.

The heat treatment apparatus 230 is arranged downstream the gate pin 41-1, and has a furnace main body 235 as shown in FIG. 9. The furnace main body 235 is made of a heat-insulating material. A belt 232 is pivotally disposed in the furnace main body 235. The belt 232 is wound on driving members 233*a* and 233*b* comprising sprockets and the like that are separated from each other at a predetermined distance. Either one of the driving members 233*a* and 233*b* is connected to the motor drive shaft (not shown), so that the belt 232 can pivot. Partitions 231 are connected to the outer circumferential surface of the belt 232 to be vertically upright, at a distance slightly larger than the free length of the coil spring W from each other.

The partitions 231 convey the coil springs W on the gutter rail 24 downward in the heat treatment furnace while partitioning them one by one.

The heat treatment apparatus 230 has a heater for heating the interior of the furnace, and a controller (not shown) for controlling an internal furnace temperature. The heat treatment apparatus 230 heat-treats the coil springs W at about 300° C. to 500° C.

A distributor 10 is arranged downstream the heat treatment apparatus 230. The distributor 10 aligns and retains the coil springs W, that have undergone heat treatment process, with a predetermined arrangement, and separates them apart from each other one by one. The distributor 10 has a guide 12, a vibrator 11, and a separation piece 13. The guide 12 aligns the coil springs W, unloaded from the heat treatment apparatus 230, in a row. The vibrator 11 moves the coil springs W in the feeding direction (from the right to the left in FIG. 8) by transmitting vibration to them. The separation piece 13 separates one coil spring W on the to p of the coil springs W arranged on the guide 12 from the remaining ones.

The automatic build-in unit 205 is arranged near the separation piece 13 and builds one coil spring W, separated by the separation piece 13, into a predetermined member.

As described above, a decrease in operability caused by entanglement of the coil springs is prevented, and a low-cost heat treatment apparatus can be realized. The structure of the heat treatment apparatus is simplified to decrease the cost. On the upstream side of the heat treatment apparatus, machined products can be reliably introduced one by one with the separation unit 40, and accordingly entanglement of the coil springs in the heat treatment apparatus is eliminated. Therefore, a decrease in reliability is not caused in the automatic build-in unit 205, and the heat treatment apparatus can be easily, directly connected to the automatic build-in unit 205.

The operation of this manufacturing line will be described.

As shown in FIG. 8, the coil springs W that are coiled by the spring coiling unit 60 are subjected to free-length measurement with the measurement unit 50, while they are conveyed on the rail 24, and are discriminated as confirming products and defective products. The nondefective product is conveyed to a subsequent step, while the defective product is discharged outside the line. The rail 24 is inclined downward from the measurement unit 50 to the heat treatment apparatus 230, and the coil spring W slides down along the gutter rail 24 until the gate pin 41-1.

The coil spring W sliding down along the rail 24 is dammed by the gate pin 41-1. A coil spring W which is located immediately upstream the dammed coil spring W is pushed by the pusher 42-2 against the rail 24.

When a spring presence/absence sensor 36 arranged at the inlet port of the furnace main body 235 of the heat treatment apparatus 230 confirms the absence of the coil spring W, the gate pin 41-1 is opened, and the dammed coil spring W slides down along the rail 24 to reach the inlet port of the heat treatment furnace.

When this coil spring W reaches the inlet port, the spring presence/absence sensor 36 determines that a spring is present. The driving members 233*a* and 233*b* are driven to rotate the partitions 231, so that one coil spring W is housed between the two, front and rear partitions 231.

This coil spring W is heat-treated as it passes through the heat treatment furnace along the rail 24 while being partitioned by the front and rear partitions 231. The heat-treated coil spring W is aligned by the guide 12, and is separated by the separation piece 13 to be built into a predetermined member with the automatic build-in unit 205.

The present invention can be applied to changes and modifications of the above embodiments without departing from the spirit and scope of the invention.

The present invention is not limited to a coil spring but can also be applied to other machined parts. According to the present invention, as described above, a decrease in operability caused by entanglement of the works is prevented, and a low-cost work convey apparatus can be realized. The structure of the work convey apparatus is simplified to decrease the cost.

On the upstream side of the heat treatment means, works can be reliably introduced one by one with the introducing means, and accordingly entanglement of the works in the heat treatment means caused by interference or collision is eliminated. Therefore, the present invention can be easily, directly connected to the automatic assembly line, and a decrease in reliability is not caused.

As many apparently widely different embodiments of the present invention can be made without departing from the spirit and scope thereof, it is to be understood that the invention is not limited to the specific embodiments thereof except as defined in the appended claims.

What is claimed is:

1. A spiral parts heat treatment apparatus for heat-treating individual ones of continuously conveyed spiral parts, comprising:

first guide means having a carrier portion that continuously conveys manufactured spiral parts carried thereon in a longitudinal direction;

transfer means, disposed downstream from said first guide means, for feeding the spiral parts one by one after discrimination;

a heat treatment furnace receiving the spiral parts from said transfer means;

second guide means provided continuously to said transfer means and having a carrier portion and a driving portion, said carrier portion serving to guide said spiral parts carried thereon in the longitudinal direction in said heat treatment furnace, and said driving portion serving to push said spiral parts from a rear end side thereof; and control means, connected to said transfer means and said driving portion, for performing a control operation so as to feed said spiral parts to said second guide means one by one, wherein said carrier portion of said second guide means is a gutter-shaped member, said heat treatment furnace has an inner wall surface formed into a substantially cylindrical shape, said gutter-shaped member is disposed substantially horizontally along said inner wall surface, and said driving portion includes a plurality of arms extending equidistantly from a rotating shaft disposed at a substantially central portion of said heat treatment furnace, and a pusher formed on an end portion of each of said arms to enter said gutter-shaped member, to pass said spiral parts upon rotation of said rotating shaft.

2. The apparatus according to claim 1, wherein said gutter-shaped member comprises multi-stage gutter-shaped members that are disposed in a vertical direction along said inner wall surface, with openings formed in bottom surfaces of said gutter-shaped members, respectively, to allow free fall of the spiral parts, and positions of upper and lower ones of the openings are displaced and said arms are formed as multi-stage arms, so that the spiral parts are allowed to freely fall onto said gutter-shaped members thereunder and are passed to be arranged longitudinally along said inner wall surface.

3. A spiral parts heat treatment method of heat-treating individual ones of continuously conveyed spiral parts by passing the spiral parts through a heat treatment furnace, comprising the steps of:

conveying, with first guide means having a carrier portion that continuously conveys the spiral parts, manufactured spiral parts carried on the carrier portion in a longitudinal direction;

conveying the spiral parts with transfer means, disposed downstream from the first guide means, for feeding the spiral parts after discrimination;

passing the spiral parts through the heat treatment furnace by a second guide means, provided continuously to the transfer means and having a carrier portion and a driving portion, the carrier portion serving to guide the spiral parts carried thereon in the longitudinal direction in the heat treatment furnace, and the driving portion serving to push the spiral parts from a rear end side thereof; and feeding the spiral parts to the second guide means one by one with control means connected to the transfer means and the driving portion, wherein the carrier portion of the second guide means is a gutter-shaped member, the heat treatment furnace has an inner wall surface formed into a substantially cylindrical shape, the gutter-shaped member is disposed substantially horizontally along the inner wall surface, and the driving portion includes a plurality of arms extending equidistantly from a rotating shaft disposed at a substantially central portion of the heat treatment furnace, and a pusher formed on an end portion of each of the arms to enter said gutter-shaped member, to pass the spiral parts upon rotation of the rotating shaft.

4. The method according to claim 3, wherein the gutter-shaped member comprises multi-stage gutter-shaped members disposed in a vertical direction along the inner wall surface, openings are formed in bottom surfaces of the gutter-shaped members, respectively, to allow free fall of the spiral parts, and positions of upper and lower ones of the openings are displaced and the arms are formed as multi-stage arms, so that the spiral parts are allowed to freely fall onto the gutter-shaped members thereunder and are passed to be arranged longitudinally along the inner wall surface.

5. A spiral parts heat treatment apparatus for heat-treating individual ones of continuously conveyed spiral parts, comprising:

first guide means having a carrier portion that continuously conveys manufactured spiral parts from a spiral parts manufacturing device;

transfer means for feeding the spiral parts one by one after discrimination;

a heat treatment furnace having a cylindrical inner wall surface for receiving the spiral parts fed by said transfer means;

second guide means provided continuously to said transfer means and having a carrier portion, said carrier portion serving to guide the spiral parts carried thereon along said cylindrical inner wall surface of said heat treatment furnace, and driving means with arms for moving the parts along said second guide means.

6. The apparatus according to claim 5, wherein said second guide means includes multiple stages and is disposed substantially horizontally along said cylindrical inner wall surface, and openings are formed in bottom surfaces of said second guide means, to allow free fall of the spiral parts.

7. The apparatus according to claim 5, wherein said driving means includes a plurality of said arms extending equidistantly from a rotating shaft disposed at a substantially central portion of said heat treatment furnace.

8. A spiral parts heat treatment method of heat-treating individual ones of continuously conveyed spiral parts by passing said spiral parts through a heat treatment furnace having a cylindrical inner wall surface, comprising the steps of:

continuously conveying manufactured spiral parts by a first guide means having a carrier portion;

feeding the spiral parts one by one with a transfer means so that the spiral parts are fed into the heat treatment furnace;

guiding the spiral parts by a second guide means provided continuously to the transfer means in a direction along the cylindrical inner wall surface of the heat treatment furnace; the cylindrical inner wall surface of the heat treatment furnace; and moving the spiral parts along the second guide means.

* * * * *